US011952876B2

(12) United States Patent
Al-Mousa et al.

(10) Patent No.: US 11,952,876 B2
(45) Date of Patent: Apr. 9, 2024

(54) WELLBORE FLUID DIVERSION

(71) Applicant: Saudi Arabian Oil Company, Dhahran (SA)

(72) Inventors: Ahmed Abdulaziz Al-Mousa, Dhahran (SA); Saad M. Budair, Dhahran (SA); Ali A. Alsaud, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/745,573

(22) Filed: May 16, 2022

(65) Prior Publication Data

US 2023/0366301 A1 Nov. 16, 2023

(51) Int. Cl.
*E21B 43/12* (2006.01)
*E21B 43/14* (2006.01)
*E21B 43/40* (2006.01)

(52) U.S. Cl.
CPC ..... *E21B 43/14* (2013.01); *E21B 43/12* (2013.01)

(58) Field of Classification Search
CPC ..... E21B 41/005; E21B 41/0057; E21B 41/0064; E21B 43/12; E21B 43/162; E21B 43/40
See application file for complete search history.

(56) References Cited

U.S. PATENT DOCUMENTS 4,175,789 A * 11/1979 Kube ..... C22B 3/08 423/17
4,890,673 A * 1/1990 Payne ..... E21B 43/40 166/266
6,305,476 B1 * 10/2001 Knight ..... E21B 17/0423 166/385
6,730,236 B2 * 5/2004 Kouba ..... B01D 17/0211 166/267
9,612,360 B2 4/2017 Zenith et al.
2006/0237194 A1 * 10/2006 Donald ..... E21B 43/162 166/305.1
2008/0017369 A1 * 1/2008 Sarada ..... E21B 43/40 166/266
2012/0024391 A1 * 2/2012 Wille ..... E21B 41/0007 166/345

(Continued)

FOREIGN PATENT DOCUMENTS

EA 015064 4/2011

OTHER PUBLICATIONS

"Chemical-Injection Pump," Halliburton Testing and Subsea, 2011, 2 pages.

(Continued)

*Primary Examiner* — Kipp C Wallace
(74) *Attorney, Agent, or Firm* — Fish & Richardson P.C.

(57) ABSTRACT

A system includes a well fluid diversion assembly configured to pump a volume of wellbore fluid from a first well to a second well of a single drilling or production platform or of different drilling or production platforms. The diversion assembly includes a first flexible tubing releasably connected to an outlet valve of a wellhead assembly of the first well and a second flexible tubing releasably connected to a wellhead assembly of the second well. The diversion assembly also includes a flowmeter and a sampling valve configured to selectively flow a portion of the volume to a fluid sampling port.

23 Claims, 3 Drawing Sheets

(56) References Cited

U.S. PATENT DOCUMENTS

| | | | | |
|---|---|---|---|---|
| 2012/0310614 | A1* | 12/2012 | Beattie | E21B 43/16 703/10 |
| 2018/0236407 | A1 | 8/2018 | Shevitz | |
| 2020/0240255 | A1* | 7/2020 | Forthuber | B01D 19/0068 |
| 2021/0363860 | A1* | 11/2021 | Rio | E21B 41/0064 |
| 2022/0098970 | A1* | 3/2022 | Deshmukh | G01N 33/2823 |
| 2022/0145733 | A1* | 5/2022 | Massey | F16L 41/02 |
| 2022/0178590 | A1* | 6/2022 | Toussaint | E21B 43/121 |

OTHER PUBLICATIONS

"Coflexip Flexible Pipe," Halliburton Testing & Subsea, 2016, 2 pages.

"Fundamentals of Orifice Meter Measurement," Daniel Measurement and Control White Papers, 2010, 9 pages.

"Micro Motion ELITE Coriolis Flow and Density Meters," Emerson, Aug. 2021, 56 pages.

"NUFLO Liquid Turbine Flow Meters," Cameron—Technical Specifications, 2013, 8 pages.

Proserv.com [online], "Sample Cylinder, Flow Through, Sulfinert Coated, 100bar," 2019, Retreived on Jun. 6, 2022, retreived from URL <https://proserv.com/wp-content/uploads/2019/01/Flow-Through-Cylinder-TPED-Inert-Coated-1450-Psi.pdf> 1 page.

* cited by examiner

WELLBORE FLUID DIVERSION

TECHNICAL FIELD

This disclosure relates to the production of oil, gas, or other resources from subterranean zones to the surface.

BACKGROUND

Hydrocarbons or other resources in subsurface reservoirs or locations below the Earth's surface can be produced to the surface via wellbores drilled from the surface to the subsurface locations. After drilling, such wells are completed by installing one or more liners and production tubing to provide a pathway for such resources to flow to the surface.

In addition to or instead of the production of valuable resources from a wellbore, is sometimes necessary or desirable to remove water, brine, gas, or other fluids from a wellbore, temporarily or permanently. The handling, containment, storage, transportation, and disposal of such fluids can present environmental, health, and other challenges.

SUMMARY

Certain aspects of the subject matter herein can be implemented as a system for managing wellbore fluids. The system includes a first well drilled into a subterranean zone from a first surface location and a second well drilled into the subterranean zone from a second surface location separate from the first surface location. The system further includes a well fluid diversion assembly that includes a pump assembly that includes a pump configured to pump a volume of wellbore fluid from the first well and a first flexible tubing. An outlet end of the first flexible tubing is connected to an inlet end of the pump assembly and an inlet end of the first flexible tubing is releasably connected to an outlet valve of a wellhead assembly of the first well. The system also includes a flowmeter configured to measure a rate of flow of the volume through the pump assembly, a fluid sampling port, and a sampling valve configured to selectively flow a first portion of the volume to the fluid sampling port. The system also includes a second flexible tubing. An inlet end of the second flexible tubing is connected to the outlet end of the pump assembly and an outlet end of the second flexible tubing is releasably connected to an inlet valve of a wellhead assembly of the second well. The well fluid diversion assembly is configured to flow a second portion of the volume to the second well.

An aspect combinable with any of the other aspects can include the following features. The first well and the second well can be wells of a single production platform.

An aspect combinable with any of the other aspects can include the following features. The first well and the second well can be wells of separate production platforms.

An aspect combinable with any of the other aspects can include the following features. The first surface location and the second surface location can be less than 100 meters from each other.

An aspect combinable with any of the other aspects can include the following features. The first surface location and the second surface location can be greater than 100 meters from each other.

An aspect combinable with any of the other aspects can include the following features. At least one of the first surface location and the second surface location can be a seafloor location.

An aspect combinable with any of the other aspects can include the following features. At least one of the first surface location and the second surface location can be a land location.

An aspect combinable with any of the other aspects can include the following features. At least one of the first flexible tubing and the second flexible tubing can be coilable.

An aspect combinable with any of the other aspects can include the following features. The flowmeter can be a first flowmeter, and the well fluid diversion assembly can also include a second flowmeter configured to measure a rate of flow of first portion flowed to the fluid sampling port.

Certain aspects of the subject matter herein can be implemented as an apparatus for transferring wellbore fluid from a first well drilled from a first surface location to a second well drilled from a second surface location separate from the first surface location. The apparatus includes a pump assembly including a pump configured to pump a volume of wellbore fluid from the first well. The apparatus also includes a first flexible tubing having an outlet end connected to an inlet end of the pump assembly and an inlet end releasably connected to an outlet valve of a wellhead assembly of the first well. The apparatus also includes a flowmeter configured to measure a rate of flow of the volume through the pump assembly, a fluid sampling port, and a sampling valve configured to selectively flow a first portion of the volume to the fluid sampling port. The apparatus can also include a second flexible tubing having an inlet end connected to the outlet end of the pump assembly and an outlet end of the second flexible tubing is releasably connected to an inlet valve of a wellhead assembly of the second well. The apparatus is configured to flow a second portion of the volume to the second well.

An aspect combinable with any of the other aspects can include the following features. At least one of the first flexible tubing and the second flexible tubing can be coilable.

An aspect combinable with any of the other aspects can include the following features. The flowmeter can include a first flowmeter. The well fluid diversion assembly can further include a second flowmeter configured to measure a rate of flow of the first portion flowed to the fluid sampling port.

Certain aspects of the subject matter herein can be implemented as a method for managing wellbore fluids. The method includes connecting, to an outlet valve of a wellhead assembly of a first well drilled from a first surface location, an inlet end of a first flexible tubing of a well fluid diversion assembly. The well fluid diversion assembly includes a pump assembly that includes a pump configured to pump a wellbore fluid through the pump assembly from an inlet end of the pump assembly to an outlet end of the pump assembly. An outlet end of the first flexible tubing is connected to the inlet end of the pump assembly and an inlet end of a second flexible tubing is connected to an outlet end of the pump assembly. The well fluid diversion assembly also includes a flowmeter configured to measure a rate of flow of the wellbore fluid through the pump assembly, a fluid sampling port, and a sampling valve configured to selectively flow at least a portion of the wellbore fluid to the fluid sampling port. The method also includes connecting, to an inlet end of an inlet valve of a wellhead assembly of a second well drilled from a second surface location separate from the first surface location, an outlet end of the second flexible tubing, flowing, by the pump, a volume of wellbore fluid from the first well through the first flexible tubing and to the well fluid diversion assembly, and diverting, through the sampling valve, a first portion of the volume of wellbore fluid to a sampling port. The method also includes sampling, from the sampling port, the first portion of the wellbore fluid, and flowing, from the well fluid diversion assembly and through the second flexible tubing, a second portion of the volume of wellbore fluid to the second well.

An aspect combinable with any of the other aspects can include the following features. The method can also include measuring, by the flowmeter, a rate of flow of the wellbore fluid through the pump assembly.

An aspect combinable with any of the other aspects can include the following features. The method can also include performing a workover operation on the first well after flowing the volume of wellbore fluid from the first well to the second well.

An aspect combinable with any of the other aspects can include the following features. The method can also include performing an intervention operation on the first well after flowing the volume of wellbore fluid from the first well to the second well.

An aspect combinable with any of the other aspects can include the following features. The first well and the second well can be wells of a single production platform.

An aspect combinable with any of the other aspects can include the following features. The first well and the second well can be wells of separate production platforms.

An aspect combinable with any of the other aspects can include the following features. At least one of the first flexible tubing and the second flexible tubing can be coilable.

An aspect combinable with any of the other aspects can include the following features. The flowmeter can be a first flowmeter and the well fluid diversion assembly can further include a second flowmeter, and the method can further include measuring, by the second flowmeter, a rate of flow of the first portion of the wellbore fluid flowed to the fluid sampling port.

The details of one or more embodiments are set forth in the accompanying drawings and the description below. Other features, objects, and advantages will be apparent from the description and drawings, and from the claims.

DETAILED DESCRIPTION

The details of one or more implementations of the subject matter of this specification are set forth in this detailed description, the accompanying drawings, and the claims. Other features, aspects, and advantages of the subject matter will become apparent from this detailed description, the claims, and the accompanying drawings.

During well operations, including drilling, completion, production, workover, abandonment, and other operations, it is sometimes necessary to permanently or temporarily remove drilling mud, displacement fluid, water, brine, acids, oil, gas, or other fluids from a wellbore. Holding, transporting, or disposing of such fluids at the surface can result in negative environmental consequences. The safe handling, transportation, and disposal of such fluids can also present health and safety challenges and can require special and expensive surface equipment. Similarly, the flaring of produced hydrocarbons can likewise negatively impact the environment and can result in the loss of otherwise potentially valuable gas and other fluids. Sampling and other characterization of such fluids can likewise be expensive, hazardous, and otherwise challenging.

In accordance with embodiments of the present disclosure, an improved fluid diversion assembly is disclosed that can more efficiently, safely, and cost-effectively manage and sample wellbore fluids with a minimum of environmental, health, and safety challenges. In some embodiments, the need for transportation, storage, flaring, and other surface activities in relation to hydrocarbons and other well fluids can be reduced or eliminated, thus minimizing or eliminating the loss of potentially valuable wellbore fluids and other economic and environmental consequences. Specifically, the diversion assembly can enable an operator to transfer wellbore fluids from one well to another, thus reducing or eliminating the need to store, transport, or otherwise dispose of the fluids at the surface. The assembly further enables an operator to measure the flow rate of fluid being transferred and to sample the fluid. In some embodiments, the fluid diversion assembly is modular and can be connected, disconnected, and transported as a unit, with flexible inlet and outlet tubing and releasable connections to enable the assembly to be easily connected and disconnected to wells positioned at different surface locations and distances relative to each other.

Figure 1:
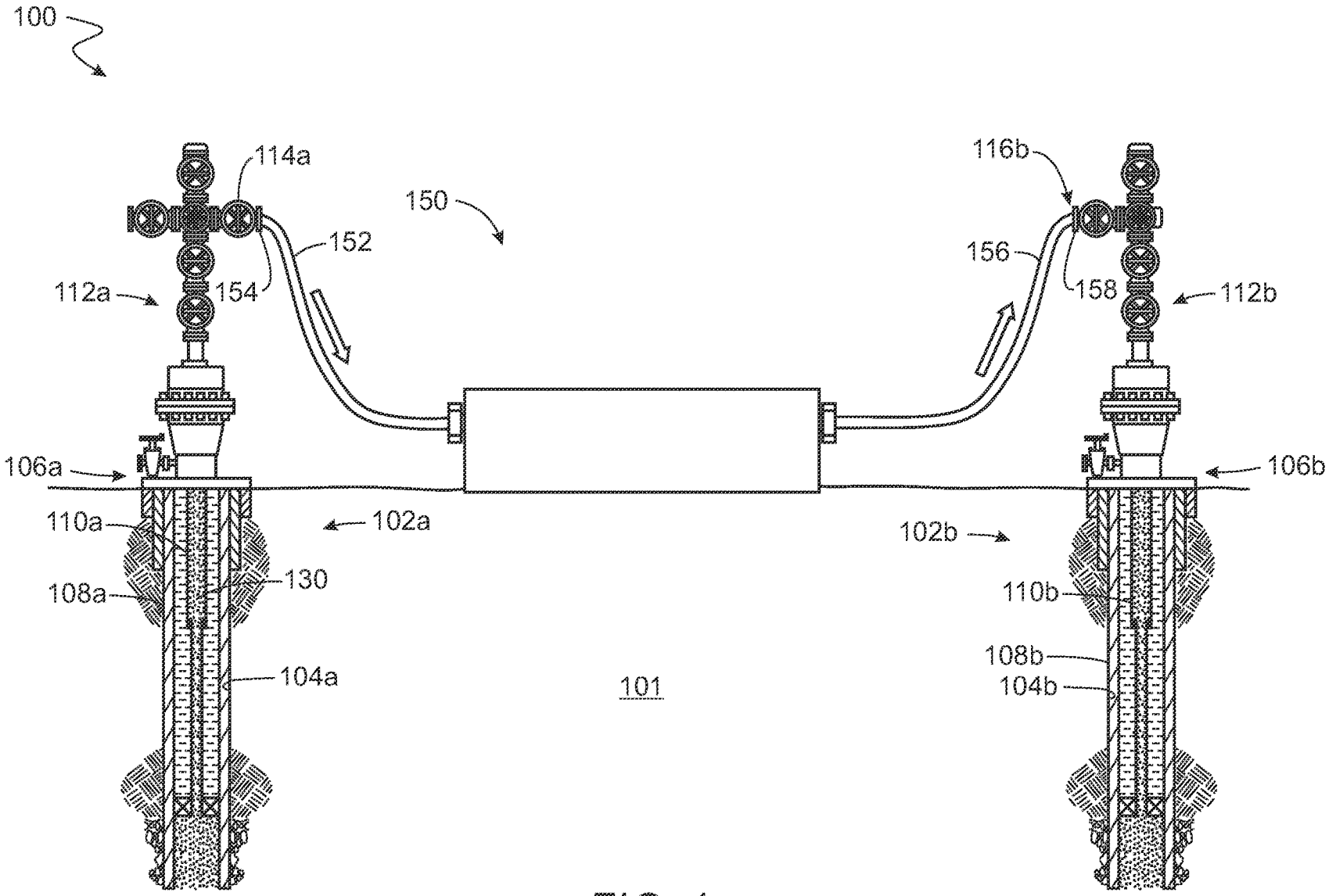
FIG. 1 is a schematic illustration of a well system with a well fluid diversion assembly in accordance with an embodiment of the present disclosure.

FIG. 1 is a schematic illustration of a system for managing wellbore fluids in accordance with an embodiment of the present disclosure. Referring to FIG. 1, system 100 includes a first well 102*a* which includes a wellbore 104*a* drilled into a subterranean zone 101 from a first surface location 106*a*. System 100 further includes a second well 102*b* which includes a wellbore 104*b* drilled into subterranean zone 101 from a second surface location 106*b* some surface distance from first surface location 106*a*. In some embodiments, one or both of surface locations 106*a* and 106*b* are land (onshore) locations. In some embodiments (for example, in conjunction with an offshore drilling or production rig), one or both of surface locations 106*a* and 106*b* can be seafloor locations. In some embodiments, surface location 106*a* can be less than 100 meters from surface location 106*b*. In other embodiments, on land or offshore locations, surface location 106*a* can be a greater distance from surface location 106*b*. In some embodiments, wells 102*a* and 102*b* can be wells of a single drilling or production platform (i.e., are drilled from or produced to single drilling or production platform, or comprise a well producing to a platform and an injection well through which fluids are injected from the same platform) and the surface locations 106*a* and 106*b* can in some embodiments be only be a few meters or less from each other. In some embodiments, wells 102*a* and 102*b* can be wells drilled from or produced to different drilling or production platforms. Subterranean zone 101 can include one or more sub-zones, such as different production zones, different geological formations or layers, or other regions or subregions within subterranean zone 101. Wellbores 104*a* can be drilled into or through the same sub-zone within subterranean zone 101 as wellbore 104*b*, or wellbores 104*a* and 104*b* can be drilled (partially or fully) into or through different sub-zones. One or both of wellbores 104*a* and 104*b* can be vertical (partially or fully), horizontal (partially or fully), or have an orientation other than vertical or horizontal.

In the illustrated embodiment, both of wells 102*a* and 102*b* have been drilled or completed so as to be production wells. It will be understood that other embodiments of the present disclosure can apply to wells other than production wells—for example, injection wells or wells that are in the process of being drilled, worked-over, completed, de-competed, or decommissioned. For example, in some embodiments, the first well can be a well in the process of being drilled and the second well can be a completed production well, or vice versa. In some embodiments, the first well can be a production well and the second well can be an injection well. In the illustrated embodiment in which both wells are production wells, first wellbore 102*a* and 102*b* include casing strings 108*a* and 108*b*, respectively, which are lengths of pipe cemented in place during the construction process to stabilize the wellbore. The casing, if present, can form a major structural component of the wellbore and can serve to stabilize the wellbore and prevent undesired flow or crossflow of fluid into the wellbore.

Production tubing strings 110*a* and 110*b* (of wells 102*a* and 102*b*), respectively) are positioned within casing strings 108*a* and 108*b*, respectively. Production tubing strings 110*a* and 110*b* provide passageways through which well fluids 130 (such as oil, gas, water, brine, drilling fluid, or other fluids) within or from wells 102*a* and 102*b* (for example, from subterranean zone 101) can travel uphole to reach the surface 106 or travel downhole towards the downhole end of the production tubing strings (and, in some circumstances, thence into the subterranean zone). Wells 102*a* and 102*b* further include wellhead assemblies 112*a* and 112*b*, respectively. Wellhead assemblies 112*a* and 112*b* are systems of spools, valves and assorted adapters that provide pressure control to the wells. For example, wellhead assembly 112*a* can include various inlet and outlet valves including, for example, outlet valve 114*a* which provides an opening from which well fluids can flow from or be extracted from well 102*a*. Similarly, wellhead assembly 112*b* can include various inlet and outlet valves including, for example, inlet valve 116*b* which provides an opening for injecting or flowing well fluids into well 102*b*. In the illustrated embodiment, wellhead assemblies 112*a* and 112*b* are production tress. Other wellhead assemblies in certain embodiments can include wellheads for drilling, workover, or other operations.

System 100 further includes a well fluid diversion assembly 150 positioned at a surface location. In the illustrated embodiment, well fluid diversion assembly 150 is positioned between wellhead assembly 112*a* and wellhead assembly 112*b*. In other embodiments, well fluid diversion assembly 150 can be positioned at another suitable surface or subsurface location. As described in greater detail in FIG. 2, wellbore diversion assembly 150 can facilitate a transfer of fluids from a first well (for example, well 102*a*) into to a second well (for example, well 102*b*) and also the sampling of such fluids before, during, or after such transfer. Wellbore diversion assembly 150 in the illustrated embodiments includes a flexible inlet tubing 152 having an inlet end 154 and a flexible outlet tubing 156 having an outlet end 158. In the illustrated embodiment, inlet end 154 is connected to outlet valve 114*a* of wellhead assembly 112*a* of first well 102*a* and outlet end 158 is connected to inlet valve 116*b* of a wellhead assembly 112*b* of the second well 102*b*. Wellhead connection types can be chosen based on site-specific needs or requirements. In some embodiments, the connections between the wellhead outlet valve 114*a* and the inlet end 154 and between outlet end 158 and inlet valve 116*b* are releasably connected; i.e., they are connected with suitable releasable connections such that the inlet end and the outlet valve can be readily connected and disconnected with no (or a minimum of) tools.

Figure 2:
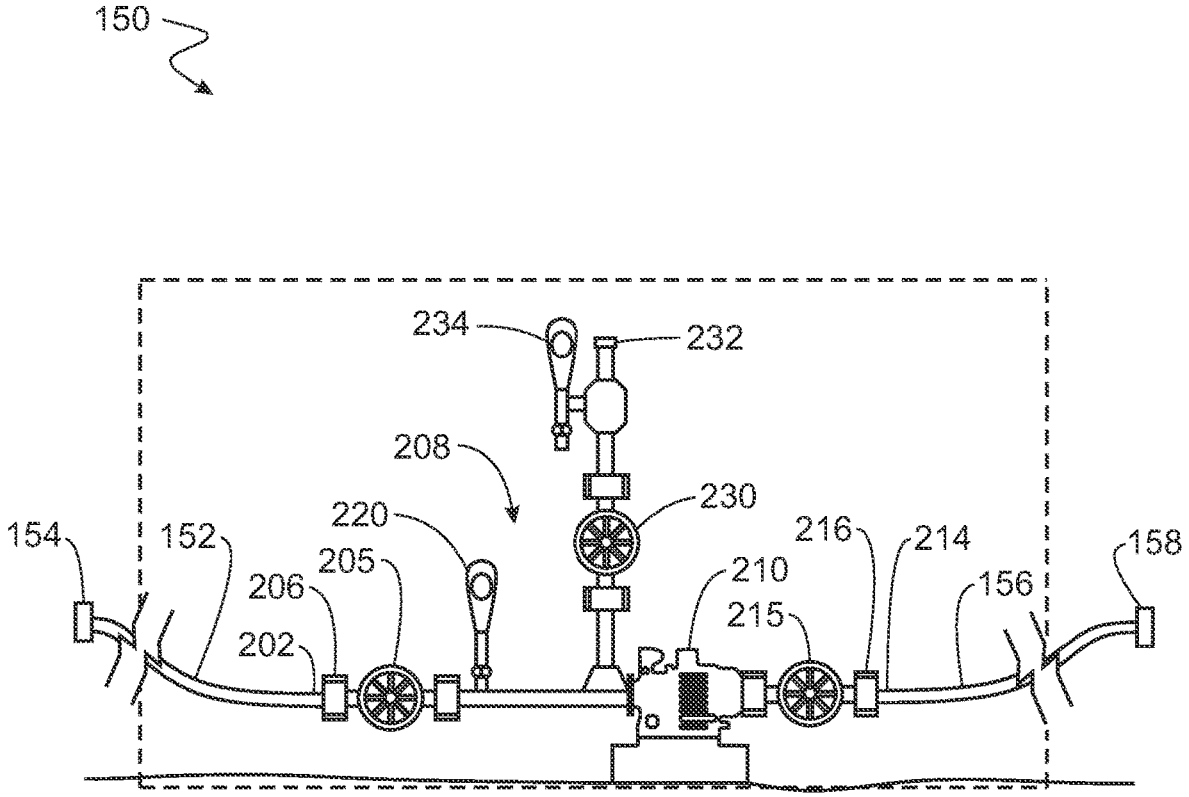
FIG. 2 is a schematic illustration of a well fluid diversion assembly in accordance with an embodiment of the present disclosure.

FIG. 2 is a schematic illustration of well fluid diversion assembly 150 of FIG. 1 in accordance with an embodiment of the present disclosure. Referring to FIG. 2, and as described above in reference to FIG. 1, well fluid diversion assembly 150 includes a flexible inlet tubing 152 having an inlet end 154 configured to be releasably attached to an outlet valve of a wellhead (for example, outlet valve 114*a* of wellhead assembly 112*a* of the first well 102*a* of FIG. 1), and a flexible outlet tubing 156 having an outlet end 158 configured to be releasably attached to an inlet valve of a wellhead (for example, inlet valve 116*b* of a wellhead assembly 112*b* of second well 102*b* of FIG. 1). Flexible inlet tubing 152 has an outlet end 202 that is connected to an inlet end 206 of a pump assembly 208. In the illustrated embodiment, the assembly further includes an inlet valve 205 configured to selectively permit flow of fluid through the connection between tubing 152 and pump assembly 208. Flexible inlet tubing 152 further includes an inlet end 206 that can be releasably connected to an outlet valve of a wellhead. Flexible outlet tubing 156 includes an inlet end 214 that is connected to an outlet end 216 of pump assembly 208. In the illustrated embodiment, the assembly further includes an outlet valve 215 configured to selectively permit flow of fluid through the connection between pump assembly 208 and outlet tubing 156. In some embodiments, flexible inlet tubing 152 and flexible outlet tubing 156 can be a coflex-type tubing such as Coflexip flexible pipe available from Halliburton Energy Services, Inc., and in some embodiments can be sufficiently flexible so as to be coilable. Such flexibility of the tubing can enable well fluid diversion assembly 150 to be easily connected to and disconnected from different wells or wellheads that are at different distances or otherwise at different spatial configurations with respect to each other. In some embodiments, well fluid diversion assembly 150 can be a transportable unit readily moved from one wellsite or platform to another. Pump assembly 208 includes a pump 210 configured to pump a fluid (for example, fluid 130 of FIG. 1) through from inlet end 154 through flexible inlet tubing 152, through pump assembly 208, and through flexible outlet tubing 156 to outlet end 158. In some embodiments, pump 210 can be a three-stage or six-stage centrifugal transfer pump, having a pumping rate of up to 300 gallons per minute (approximately 10285.7 barrels per day). In some embodiments, pump 210 can be a DSTV-100 chemical injection pump available from Halliburton Energy Services, Inc., having a maximum flow rate of 0.1 gallons per minute at 1500 pounds per square inch gauge (psig) with maximum air drive pressure. In some embodiments, pump 210 can be a Type 14 pump available from MacFarland Pumps, having a maximum flow rate of 1.65 gallons per minute at 13,370 psig with maximum air drive pressure. In some embodiments, pump 210 can be another suitable pump. Pump assembly 210 can include more than one pump, such as a combination of two or more of the preceding pump types.

Well fluid diversion assembly 150 in the illustrated embodiment further includes flowmeter 220 configured to measure a rate of flow of the fluid flowing through pump assembly 208. Flowmeter 220 can be a gas flowmeter, a liquid flowmeter, or a combination of different flowmeter types, with flowmeter type, size and other features chosen depending on the type or mix of fluid, flow rate, or other factors. In some embodiments, flowmeter 220 can be an orifice 6" or 2" orifice gas flowmeter of the type available from Daniel Measurement and Control, Inc. In some embodiments, flowmeter 220 can be a 3" CMF300M flowmeter or CMF400M flowmeter available from Micro Motion, Inc. (Emerson). In some embodiments, flowmeter 220 can be a turbine liquid flowmeter of ⅞" to 2" size of a type available from Cameron. In some embodiments, flowmeter 220 can be another suitable flowmeter type.

In the illustrated embodiment, well fluid diversion assembly 150 further includes a a sampling valve 230 configured to selectively divert at least a portion of the fluid flowing through pumps assembly 208 to a fluid sampling port 232. A sampling flowmeter 234 in the illustrated embodiment is connected between sampling valve 230 and sampling port 232 and is configured to measure a rate of flow of the fluid flowing to fluid sampling port 232. Sampling flowmeter 234 can be a gas flowmeter, a liquid flowmeter, or a combination of different flowmeter types, with flowmeter type, size and other features chosen depending on the type or mix of fluid, flow rate, or other factors. In some embodiments, sampling flowmeter 234 can be a flowmeter of the type described above with respect to flowmeter 220, or another suitable flowmeter type. In some embodiments, fluids sampled from fluid sampling port 232 can be captured in a sample cylinder (not shown), for example, of the type available from Proserve, or another suitable sample cylinder.

In operation, well fluid diversion assembly 150 enables the operator to selectively pump, at a selected volume and rate, wellbore fluid from a first well (for example, well 102*a* of FIG. 1) to a second well (for example, well 102*b* of FIG. 1). Well fluid diversion assembly 150 further enables an operator to measure the flow rate of fluid being transferred and to sample the fluid. In some embodiments, well fluid diversion assembly 150 is a modular assembly that can be connected, disconnected, and transported as a unit, and the flexible inlet and outlet tubing and the releasable connections can enable the assembly to be easily connected and disconnected to wells positioned at different surface locations and distances relative to each other. The volume, type, and other characteristics of the fluid transferred from the first well to the second well can vary depending on several factors including but not limited to the objective or purpose of the transfer, the geological properties of the first well or second well. For example, if the objective or purpose is to transfer wellbore fluid from the first well in order to safely workover the first well (for example, in the context of a well intervention) then the amount of fluid transferred from the first well to the second well can be relatively small, depending on the volume of fluids required to be extracted from the first wellbore to enable the workover or other intervention activities. A relatively high porosity and permeability of the geologic formation into which the second well is drilled can enable a relatively high volume of fluids to be transferred from the first well to the second well. In some embodiments, well fluid diversion assembly 150 can be configured to transfer fluids to more than one receiving well. In some embodiments, only a portion of the volume of fluid extracted from the first well is transferred to the second well, with the remaining volume stored, transported, or otherwise managed at the surface. In some embodiments, well fluid diversion assembly can be configured to transfer fluids to more than one receiving well (for example, a third well and/or a fourth well).

Figure 3:
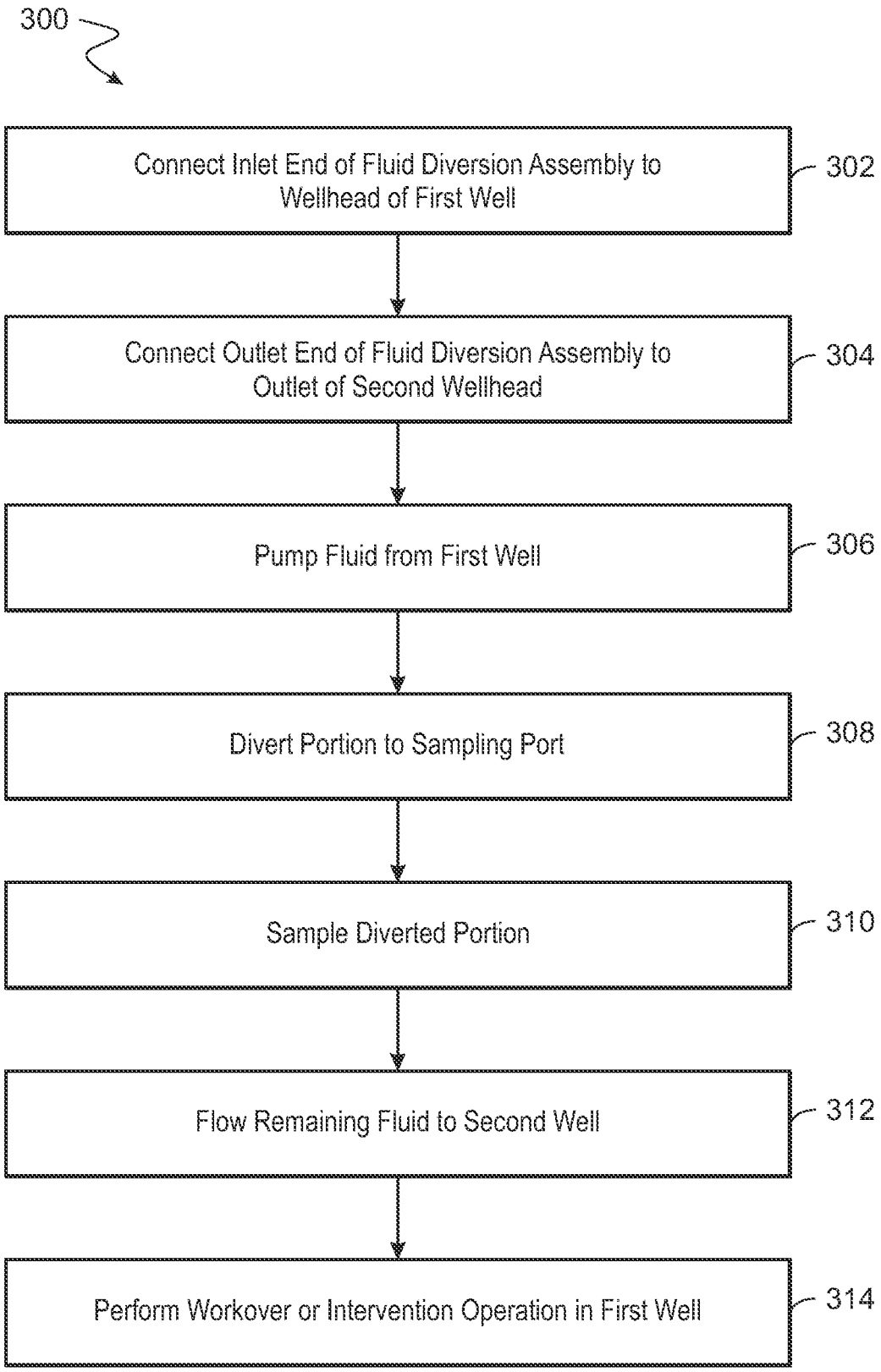
FIG. 3 is a process flow diagram of a method of managing well fluids in accordance with an embodiment of the present disclosure.

FIG. 3 is a process flow diagram of a method 300 of managing well fluids in accordance with an embodiment of the present disclosure. The method begins at step 302 in which an inlet end of a first flexible tubing of a well fluid diversion assembly is connected to an outlet valve of a wellhead assembly of a first well (for example, well 102*a* of FIG. 1) drilled from a first surface location. In some embodiments, the well fluid diversion assembly can be, for example, well fluid diversion assembly 150 of FIG. 2 and can include a pump assembly having a pump configured to pump a wellbore fluid through the pump assembly from an inlet end of the pump assembly to an outlet end of the pump assembly. An outlet end of the first flexible tubing can be connected to the inlet end of the pump assembly, and an inlet end of a second flexible tubing of the assembly can be connected to an outlet end of the pump assembly. The well fluid diversion assembly can further include a flowmeter configured to measure a rate of flow of the wellbore fluid through the pump assembly, a fluid sampling port, and a sampling valve configured to selectively flow at least a portion of the wellbore fluid to the fluid sampling port.

Proceeding to step 304, an inlet end of an inlet valve of a wellhead assembly of a second well (for example, well 102*b* of FIG. 1) drilled from a second surface location separate from the first surface location can be connected to an outlet end of the second flexible tubing of the well fluid diversion assembly. Proceeding to step 306, a volume of wellbore fluid from the first wellbore is pumped by the pump through the first flexible tubing and to the well fluid diversion assembly. In some embodiments, the rate of flow of the wellbore fluid flowed to the well fluid diversion assembly is measured by a flowmeter.

At step 308, a first portion of the volume of wellbore fluid is diverted through the sampling valve to the sampling port and, at step 310, the first portion is sampled by the operator. In some embodiments, the rate of flow of the first portion of the wellbore fluid flowed to the fluid sampling port is measured by a second flowmeter. At step 312, a second portion of the volume of wellbore fluid (for example, the remaining portion of the volume after the first portion is diverted) is flowed from the well fluid diversion assembly and through the second flexible tubing to the second well. At step 314, after the wellbore fluid is flowed from the first well to the second well, a workover operation, intervention operation, or other desired or necessary operation can be performed on or in the first well.

The term "uphole" as used herein means in the direction along the wellbore (or along a production tubing, drill string, or other tubular disposed within the wellbore) from its distal end towards the surface, and "downhole" as used herein means the direction along the along the wellbore (or along a production tubing, drill string, or other tubular disposed within the wellbore) from the surface towards its distal end. A downhole location means a location along the tubular or wellbore downhole of the surface.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A system for managing wellbore fluids, the system comprising:

a first pair of wells drilled into a subterranean zone, the first pair of wells drilled from a first surface location;

a second pair of wells drilled from a second surface location separate from the first surface location, the second pair of wells having a distance relative to each other that is different than a distance relative to each other of the first pair of wells;

a well fluid diversion apparatus, the apparatus comprising:

a pump assembly comprising a pump configured to pump a volume of wellbore fluid from a first well;

a first flexible tubing, wherein an outlet end of the first flexible tubing is connected to an inlet end of the pump assembly;

a flowmeter configured to measure a rate of flow of the volume through the pump assembly;

a fluid sampling port;

a sampling valve configured to selectively flow a first portion of the volume to the fluid sampling port;

a second flexible tubing, wherein an inlet end of the second flexible tubing is connected to an outlet end of the pump assembly such that, when an inlet end of the first flexible tubing is connected to an outlet valve of a wellhead of a first well of a first pair of wells and an outlet end of the second flexible tubing is connected to an inlet valve of a wellhead assembly of a second well of a first pair of wells, a second portion of the volume can flow from the first well of the to the second well;

wherein the apparatus is a modular, readily transportable unit with an inlet end of the first flexible tubing and an outlet end of the second flexible tubing each comprising readily releasable connections and the first flexible tubing and the second flexible tubing are coilable, such that:

the first flexible tubing and the second flexible tubing can be disconnected from the outlet valve of the wellhead of the first well of the first pair of wells and the inlet valve of the wellhead of the second well of the first pair of wells;

wherein the apparatus is configured to be readily disconnected from the first pair of wells, transported as a modular unit to the second pair of wells; and connected to an outlet valve of a wellhead of a first well of the second pair of wells and an inlet valve of a wellhead of a second well of the second pair of wells, respectively.

2. The system of claim 1, wherein the first pair of wells and the second pair of wells are wells of a single production platform.

3. The system of claim 1, wherein the first pair of wells and the second pair of wells are wells of separate production platforms.

4. The system of claim 3, wherein at least one of the first surface location and the second surface location is a seafloor location.

5. The system of claim 3, wherein at least one of the first surface location and the second surface location is a land location.

6. The system of claim 3, wherein the flowmeter comprises a first flowmeter, and wherein the apparatus further comprises a second flowmeter configured to measure a rate of flow of first portion flowed to the fluid sampling port.

7. The system of claim 3, wherein the modular, transportable unit is configured such that, and the coilable of the first flexible tubing and the second flexible tubing is such that, a difference between the distance relative to each other of the first pair of wells and the distance relative to each other of the second pair of wells can be greater than about 100 meters.

8. The system of claim 3, wherein the apparatus is configured such that a third portion of the volume pumped from the first well by the apparatus is flowed from the apparatus and not flowed to the second well of the first pair of wells.

9. An apparatus for transferring wellbore fluid, the apparatus comprising:

a pump assembly comprising a pump configured to pump a volume of wellbore fluid;

a first flexible tubing, wherein an outlet end of the first flexible tubing is connected to an inlet end of the pump assembly, a flowmeter configured to measure a rate of flow of the volume through the pump assembly;

a fluid sampling port;

a sampling valve configured to selectively flow a first portion of the volume to the fluid sampling port; and a second flexible tubing, wherein an inlet end of the second flexible tubing is connected to an outlet end of the pump assembly such that, when an inlet end of the first flexible tubing is connected to an outlet valve of a wellhead of a first well of a first pair of wells and an outlet end of the second flexible tubing is connected to an inlet valve of a wellhead assembly of a second well of a first pair of wells a second portion of the volume can flow from the first well to the second well;

wherein the apparatus is a modular, readily transportable unit with an inlet end of the first flexible tubing and an outlet end of the second flexible tubing each comprising readily releasable connections and the first flexible tubing and the second flexible tubing are coilable, such that:

the first flexible tubing and the second flexible tubing can be disconnected from the outlet valve of the wellhead of the first well of the first pair of wells and the inlet valve of the wellhead of the second well of the first pair of wells;

wherein the apparatus is configured to be readily disconnected from the first pair of wells, transported as a modular unit to a second pair of wells having a distance relative to each other that is different than a distance relative to each other of the first pair of wells, and connected to an outlet valve of a wellhead of a first well of the second pair of wells and an inlet valve of a wellhead of a second well of the second pair of wells, respectively.

10. The apparatus of claim 9, wherein the flowmeter comprises a first flowmeter, and wherein the apparatus further comprises a second flowmeter configured to measure a rate of flow of the first portion flowed to the fluid sampling port.

11. The apparatus of claim 9, wherein the modular, transportable unit is configured such that, and the coilable of the first flexible tubing and the second flexible tubing is such that, a difference between the distance relative to each other of the first pair of wells and the distance relative to each other of the second pair of wells can be greater than about 100 meters.

12. The apparatus of claim 9, wherein at least one of the first pair of wells and the second pair of wells is at a seafloor location.

13. The apparatus of claim 9, wherein the apparatus is configured such that a third portion of the volume pumped from the first well by the apparatus is flowed from the apparatus and not flowed to the second well of the first pair of wells.

14. A method for managing wellbore fluids, the method comprising:

disconnecting, from an outlet valve of a wellhead assembly of a first well of a first pair of wells drilled from a first surface location, an inlet end of a first flexible tubing of a well fluid diversion apparatus via a releasable connection on the inlet end of the first flexible tubing, wherein the apparatus is a modular, transportable unit and comprises:

a pump assembly comprising a pump configured to pump a wellbore fluid through the pump assembly from an inlet end of the pump assembly to an outlet end of the pump assembly, wherein an outlet end of the first flexible tubing is connected to the inlet end of the pump assembly, and wherein an inlet end of a second flexible tubing is connected to an outlet end of the pump assembly;

a flowmeter configured to measure a rate of flow of the wellbore fluid through the pump assembly;

a fluid sampling port;

a sampling valve configured to selectively flow at least a portion of the wellbore fluid to the fluid sampling port;

disconnecting, from an inlet end of an inlet valve of a wellhead assembly of a second well of the first pair of wells, an outlet end of the second flexible tubing via releasable connections on the outlet end of the second flexible tubing;

after the disconnecting, coiling the first flexible tubing and the second flexible tubing and transporting the apparatus as a modular unit to a second pair of wells, wherein the second pair of wells has a distance relative to each other that is different than a distance relative to each other of the first pair of wells;

connecting, to an outlet valve of a wellhead assembly of a first well of a second pair of wells drilled from a second surface location, the inlet valve of the first flexible tubing;

connecting, to an inlet valve of a wellhead assembly of a second well of the second pair of wells, the outlet valve of the second flexible tubing;

flowing, by the pump, a volume of wellbore fluid from the first well of the second pair of wells through the first flexible tubing and to the apparatus;

diverting, through the sampling valve, a first portion of the volume of wellbore fluid to a sampling port;

sampling, from the sampling port, the first portion of the wellbore fluid; and flowing, from the apparatus and through the second flexible tubing, a second portion of the volume of wellbore fluid to the second well of the second pair of wells.

15. The method of claim 14, further comprising measuring, by the flowmeter, a rate of flow of the wellbore fluid through the pump assembly.

16. The method of claim 14, further comprising performing a workover operation on the first well of the second pair of wells after flowing the volume of wellbore fluid from the first well to the second well.

17. The method of claim 14, further comprising performing an intervention operation on the first well of the second pair of wells after flowing the volume of wellbore fluid from the first well of the second pair of wells to the second well of the second pair of wells.

18. The method of claim 14, wherein the first pair of wells welt and the second pair of wells are wells of a single production platform.

19. The method of claim 14, wherein the first pair of wells and the second pair of wells are wells of separate production platforms.

20. The method of claim 14, wherein the flowmeter comprises a first flowmeter and the apparatus further comprises a second flowmeter, and wherein the method further comprises measuring, by the second flowmeter, a rate of flow of the first portion of the wellbore fluid flowed to the fluid sampling port.

21. The method of claim 14, wherein the modular, transportable unit is configured such that, and the coilable of the first flexible tubing and the second flexible tubing is such that, a difference between the distance relative to each other of the first pair of wells and the distance relative to each other of the second pair of wells can be greater than about 100 meters.

22. The method of claim 14, wherein at least one of the first pair of wells and the second pair of wells is at a seafloor location.

23. The method of claim 14, further comprising flowing from the apparatus a third portion of the volume pumped from the first well of the second pair of wells, the third portion not flowed to the second well of the second pair of wells.

* * * * *